US006749227B2

(12) United States Patent
Margid

(10) Patent No.: US 6,749,227 B2
(45) Date of Patent: Jun. 15, 2004

(54) ADJUSTABLE POLE AND LOCK

(75) Inventor: Jordan Margid, Salt Lake City, UT (US)

(73) Assignee: Black Diamond Equipment Ltd., Inc., Salt Lake City, UT (US)

( * ) Notice: Subject to any disclaimer, the term of this patent is extended or adjusted under 35 U.S.C. 154(b) by 0 days.

(21) Appl. No.: 10/192,137

(22) Filed: Jul. 9, 2002

(65) Prior Publication Data

US 2003/0011187 A1 Jan. 16, 2003

Related U.S. Application Data

(60) Provisional application No. 60/304,228, filed on Jul. 10, 2001.

(51) Int. Cl.[7] ..... A63C 11/00

(52) U.S. Cl. ..... 280/823; 135/75; 403/109.3

(58) Field of Search ..... 280/823, 819; 135/75, 65; 403/109.1, 109.2, 109.3, 108, 109.6, 109.7, 109.8

(56) References Cited

U.S. PATENT DOCUMENTS

| | | | | | |
|---|---|---|---|---|---|
| 401,061 | A | * | 4/1889 | Pilon et al. | 135/75 |
| 973,466 | A | | 10/1910 | Beegen | |
| 1,072,253 | A | | 9/1913 | Peck | |
| 2,390,267 | A | * | 12/1945 | Pearce | 280/823 |
| 2,673,102 | A | | 3/1954 | Hutchinson | |
| 2,862,275 | A | | 12/1958 | Kessler | |
| 3,084,964 | A | | 4/1963 | Ruth | |
| 3,305,234 | A | | 2/1967 | Cline et al. | |
| 3,828,403 | A | | 8/1974 | Perrin et al. | |
| 4,056,115 | A | * | 11/1977 | Thomas | 403/108 X |
| 4,085,763 | A | * | 4/1978 | Thomas | 135/75 X |
| 4,114,911 | A | * | 9/1978 | Laird et al. | 280/823 |
| 4,137,793 | A | | 2/1979 | Sowell | |
| 4,381,585 | A | | 5/1983 | Morel | |
| 4,616,668 | A | * | 10/1986 | Battiston | 403/108 |
| 5,366,263 | A | | 11/1994 | Hendrickson | |
| 5,387,048 | A | * | 2/1995 | Kuo | 403/109.1 |
| 5,441,307 | A | | 8/1995 | Quintana et al. | |
| 5,478,117 | A | | 12/1995 | Quintana et al. | |
| 6,223,628 | B1 | * | 5/2001 | Barron | 81/53.11 |
| 6,461,074 | B2 | * | 10/2002 | Taylor | 403/109.1 X |

FOREIGN PATENT DOCUMENTS

| | | |
|---|---|---|
| DE | 2632201 | 1/1978 |
| GB | 503714 | 4/1939 |

OTHER PUBLICATIONS

U.S. patent application Publication 2002/0179134—dated Dec. 2002.*

* cited by examiner

*Primary Examiner*—Bryan Fischmann
(74) *Attorney, Agent, or Firm*—Thorpe North & Western

(57) ABSTRACT

A locking mechanism interconnects telescoping outer and inner tubes between extended and retracted lengths, such as for a trek or ski pole. A detent or pin movably extends between the outer and inner tubes to secure the tubes with respect to one another. A connector sleeve can be disposed on one tube, and movably receive the other tube therein. A button can be carried by the sleeve, and is depressable to force the pin away from the outer tube, allowing the inner tube to slide. The button can be formed on an annular band that deforms when the button is depressed, and the resiliently returns to its initial shape when released to bias the button away from the detent or pin.

19 Claims, 3 Drawing Sheets

ADJUSTABLE POLE AND LOCK

This Application claims the benefit of U.S. Provisional Patent Application Serial No. 60/304,228, filed Jul. 10, 2001.

BACKGROUND OF THE INVENTION

1. Field of the Invention

The present invention relates generally to adjustable length ski and trek/hiking poles for use in back country and cross country skiing, hiking, and the like. More particularly, the present invention relates to a lock for adjustably and selectively locking the adjustable pole in a desired length.

2. Related Art

Trekking or hiking poles are used by hikers for stability when hiking. Such poles can be collapsible or otherwise adjustable in length between an extended and usable length, and a retracted and storable length. Similarly, ski poles also can be adjustable in length to obtain an optimal fit to the user. Such poles can include fixed length type poles, and infinitely adjustable type poles. The fixed length type poles have a number of discrete lengths, such as two or more sections that couple end-to-end, or a plurality of holes with a detent. The infinitely adjustable type poles have an infinite number of lengths, such as outer poles that releasably squeeze about an inner pole at any desired location.

SUMMARY OF THE INVENTION

It has been recognized that it would be advantageous to develop an adjustable length ski or trek pole, and/or an adjustment or locking mechanism thereof, that is simple to use and inexpensive to make.

The invention provides a lock device for a telescoping pole, such as an adjustable length ski or trek pole device. A plurality of telescoping pole sections can be telescopically coupled together, and movable with respect to one another between extended and retracted lengths. In the extended length, the pole device has a longer length. In the retracted length, the pole device has a shorter length. The plurality of telescoping pole sections can include at least an inner pole section movably received within an outer pole section.

The lock device includes a connector sleeve disposed on the outer pole section, and movably receiving the inner pole section therein. An aperture can be formed in the connector sleeve. A detent element is engagable with the aperture of the connector sleeve to secure the inner pole section and the outer pole section with respect to one another.

A button advantageously can be disposed on the annular band, and over the aperture in the connector sleeve and the detent element. The button can be movable to an unlock position in which the button presses the detent element from the aperture in the connector sleeve so that the inner pole section and outer pole section can move with respect to one another.

In accordance with a more detailed aspect of the present invention, the button can be disposed on an annular band that extends around the connector sleeve. The annular band can be compliant to flex when the button is pressed to the unlock position. In addition, the annular band can be resilient to bias the button away from the detent element. The connector sleeve can include a groove that receives the annular band.

In accordance with another more detailed aspect of the present invention, one or more flexible arms can be disposed adjacent the aperture of the connector sleeve to bias the button away from the aperture and the detent element.

In accordance with another more detailed aspect of the present invention, the plurality of pole sections can include: 1) an outermost and uppermost pole section with a handle disposed on an upper end thereof; 2) an intermediate pole section, slidably disposed in the outermost and uppermost pole section; and 3) an innermost and lowermost pole section, slidably disposed in the intermediate pole section, with a tip disposed on a lower end thereof. An upper connector sleeve can be disposed on one end of the outermost and uppermost pole section. A lower connector sleeve, disposed on one end of the intermediate pole section, and movably receiving the innermost and lowermost pole section therein.

Additional features and advantages of the invention will be apparent from the detailed description which follows, taken in conjunction with the accompanying drawings, which together illustrate, by way of example, features of the invention.

DETAILED DESCRIPTION

Figure 2:
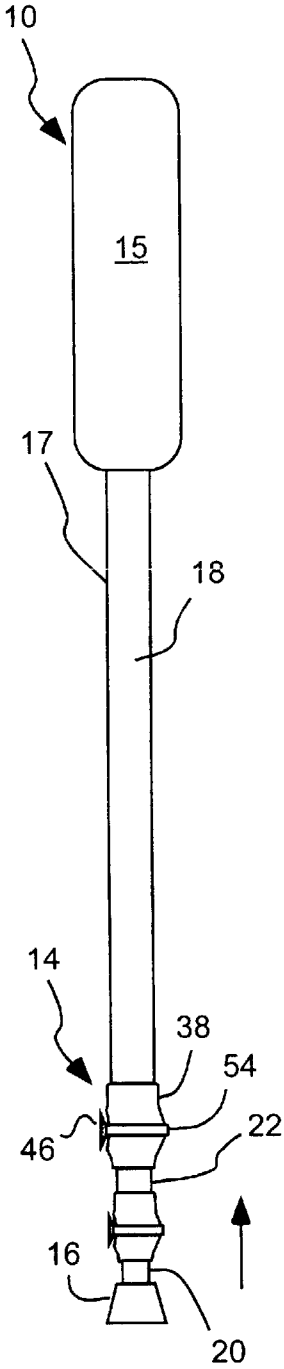
FIG. 2 is a side view the pole device with the locking mechanism of FIG. 1, with the pole device shown in a retracted configuration.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

As illustrated in FIGS. 1–14, an adjustable length pole 10 and an adjustment or locking mechanism 14 in accordance with the present invention are shown to selectively adjust the length of the pole 10. Trekking, hiking, skiing, and snowshoeing are examples of fields that may benefit from the use of such a pole 10 or locking mechanism 14. The pole 10 can be a trek pole (as shown) or a ski pole with the appropriate handle 15, strap, and/or tip 16 for the desired application. For example, the tip can include a basket for skiing, or a blunt rubber knob for trekking.

Figure 1:
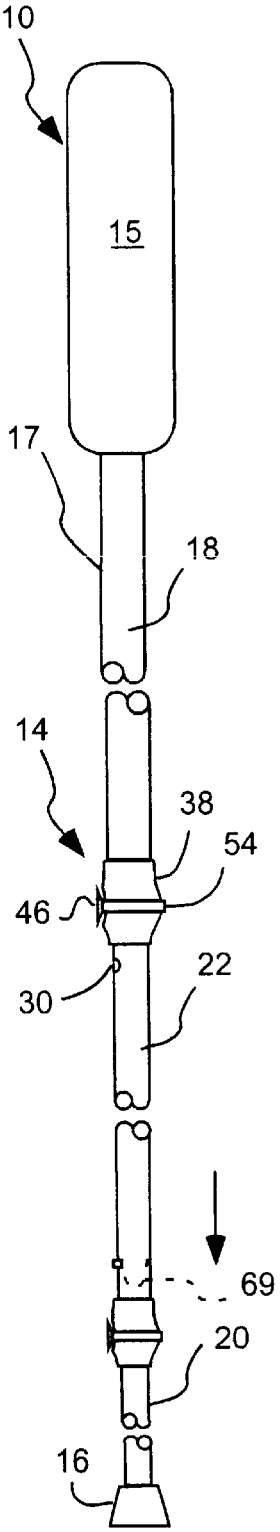
FIG. 1 is a side view of a pole device with a locking mechanism in accordance with the present invention, with the pole device shown in an extended configuration.

The pole 10 can include a plurality of telescoping tubular members or pole sections slidably engaging one another. The pole 10 or pole sections telescope between extended and retracted positions or lengths. In the extended length, the pole sections extend from one another to a larger length (as shown in FIG. 1), suitable for the desired use. In the retracted length, the pole sections are received within one another to a smaller length (as shown in FIG. 2). In addition, the pole section can extend partially from one another to an intermediate length, appropriate for adjusting the length of the pole to suit the user. A trek type pole can be configured to collapse to a smaller length for storage, and extend for a longer length for use. A ski type pole can be configured to adjust to a desired length for use.

For example, the pole 10 can be configured as a trek pole and can include three pole sections, including: 1) an outermost and uppermost section 18 with a larger diameter; 2) an innermost and lowermost section 20 with a smaller diameter; and 3) an intermediate section 22 disposed between the outermost and lowermost sections 18 and 20. The lowermost section 20 can be slidably received within the intermediate section 22, while the intermediate section 22 can be slidably received within the outermost section 18. Such a configuration with three sections is well suited for use as a trek pole because such a configuration can collapse to a shorter length. The outermost and uppermost section can be provided with a handle 15 on its upper end for the user to grasp, while the innermost and lowermost section can be provided with a tip 16 on its lower end, such as a knob.

As another example, the pole 10 can be configured as a ski pole and can include two pole sections, including: 1) an outermost and uppermost section 18 with a larger diameter; and 2) an innermost and lowermost section 22 with a smaller diameter. Again, the innermost section 22 can be slidably disposed in the outermost section 18. The two sections can be adjusted to form the desired length. Again, the outermost and uppermost section can be provided with a handle 15 at its upper end for the user to grasp, while the innermost and lowermost section can be provided with a tip on its lower end, such as a basket.

A handle 15 can be disposed at a top of the uppermost section 18 at a top of the pole, while a tip 16 can be disposed at a bottom of the lowermost section 20 at a bottom of the pole. The tip can be configured for the desired use of the pole. For example, a basket can be included for use as a ski type pole.

In accordance with one aspect of the present invention, the pole 10 can be configured as a trek pole that is both 1) collapsible to a shorter length for storage (as shown in FIG. 2), and 2) adjustable in length to achieve a desired length (as shown in FIG. 1). Thus, the pole can have three telescoping sections as described above. Two of the pole sections can be adjustably connected by any type of adjustable locking mechanism, such as an infinitely adjustable locking mechanism. Thus, the pole 10 can be selectively adjusted to have the desired length. One type of locking mechanism that can be used is shown in U.S. Pat. Nos. 5,441,307 and 5,478,117, which are herein incorporated by reference. Another two sections can be connected with the locking mechanism 14 of the present invention. Therefore, the pole 10 can be both extendable/retractable, and infinitely adjustable.

It is of course understood that the pole 10 can be configured with any number of sections. It is also understood that the sections can be connected in any configuration, such as all connected with the locking mechanism 14 of the present invention, or only two section connected with the locking mechanism 14 of the present invention. In addition, while the outermost section has been described as the uppermost section, and the innermost section has been described as the lowermost section, it will be appreciated that the poles can be configured opposite such a configuration.

For simplicity, only one locking mechanism 14 and two pole sections 18 and 22 are described below, including an outer section or tube 18 and an inner section or tube 22 slidably received within the outer section. It will be appreciated that the outer section 18 can be the uppermost section while the inner section 22 can be the intermediate section; or the outer section 18 can be the intermediate section while the inner section 22 can be the lowermost section.

The locking mechanism 14 of the present invention interconnects the outer and inner sections 18 and 22. In one aspect, the locking mechanism 14 can interconnect the sections 18 and 22 at multiple relative positions with respect to one another so that the pole can be adjusted through a plurality of discrete lengths between the expanded and retracted lengths, thus giving the pole 10 some adjustment. In another aspect, the locking mechanism 14 can interconnect the sections 18 and 22 at only one or two relative positions corresponding to the expanded and retracted lengths of the pole 10.

The locking mechanism 14 can include one or more detent elements or pins 26 that selectively engage both the outer and inner sections 18 and 22 to selectively secure the sections 18 and 22 together. In one aspect, the detents or pins 26 are disposed in the inner section 22. One or more holes or apertures 30 can be formed in the inner section 22 to movably receive the detent(s) or pin(s) 26 therein. The detent(s) or pin(s) 26 can be biased outwardly through the hole 30, such as with a spring. For example, a spring 34 can operatively engage the detent or pin 26 to bias the pin outwardly through the hole. The spring 34 can be a generally U-shaped member with the detent or pin 26 disposed at the free end thereof. The free end of the spring 34 can be spaced apart greater than the inner diameter of the inner section 22, such that the free ends must be forced closer together, compressing the spring, and causing the spring to push outwardly on the detent(s) or pin(s).

The detent(s) or pin(s) 26 can operatively engage the outer section 18 through the hole 30 in the inner section 22 to secure the sections 18 and 22 together. The outer section 18 can include a corresponding hole to receive the pin(s) 26. In one aspect, the locking mechanism 14 also can include a connector sleeve 38 secured to the outer section 18. The sleeve 38 can be a tubular member with a hollow therein. The sleeve 38 can be fixedly attached to a lower end of the outer section 18, and slidably receive the inner section 22 therethrough. One or more holes or apertures 42 can be formed in the sleeve 38 to removably receive the detent(s) or pin(s) 26. The sleeve 38 can be a separate component from the tube section, or can be integrally formed therewith.

The locking mechanism 14 can include locked (FIG. 3) and unlocked (FIG. 4) configuration, corresponding to secured and unsecured configurations of the outer and inner sections 18 and 22. In the locked configuration, the detent(s) or pin(s) 26 extend through the hole(s) 30 in the inner section 22, and through the hole(s) 42 in the sleeve 38 that is attached to the outer section 18, thus securing the sections 18 and 22 together. In the unlocked configuration, the pin(s) 26 can be removed from the hole(s) 42 in the sleeve 38, allowing the inner section 22 to slide within the outer section 18 and the sleeve 38. The locking mechanism 14 can be unlocked, and the sections 18 and 22 unsecured, by forcing or pressing the pin(s) 26 inwardly, and thus out of the hole(s) 42 of the sleeve 38.

One or more button(s) 46 advantageously are disposed over the hole(s) 42 of the sleeve 38. The button 46 preferably is sized larger than the hole 42 and covers the hole to prevent fouling and/or interference with the detent or pin 26. In addition, the button 46 resists a user's finger from being pinched in the hole 42 of the sleeve. The button 46 provides a larger surface area against which the user can press, relieving stress on the user's fingers, and providing greater comfort. The button 46 is movably disposed over the hole 42 and movable inwardly and outwardly. Thus, the locking mechanism 14 can be unlocked by depressing the button 46 (indicated by arrow 48 in FIG. 4), which engages the pin 26 and forces the pin out of the hole 42 in the sleeve 38. The button 46 can include a protrusion 50 formed on a rear side thereof to engage the pin 26. The button 46 can be carried by or on the sleeve 38. Indentations and/or raised portions 52 (FIG. 12) on an outer surface of the button to resist the user's finger from slipping off the button while being pressed.

Figure 3:
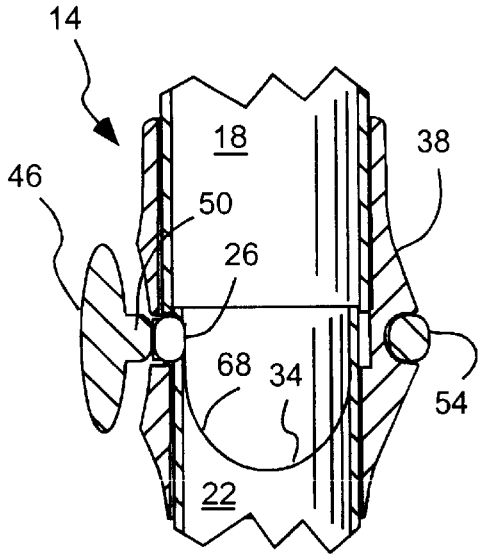
FIG. 3 is a cross-sectional side view of the locking mechanism of FIG. 1 shown in a locked position.
Figure 4:
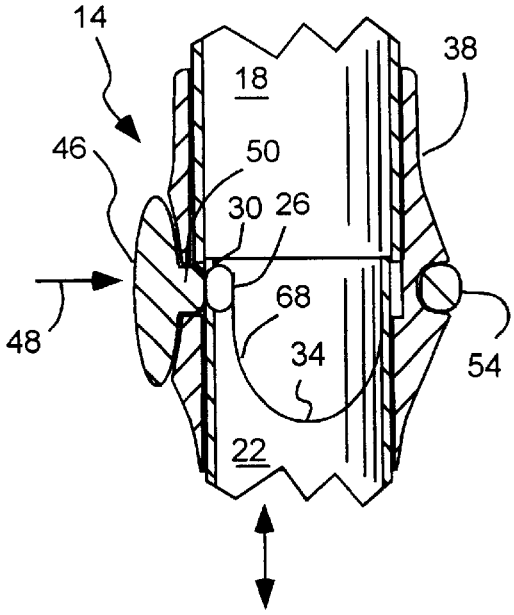
FIG. 4 is a cross-sectional side view of the locking mechanism of FIG. 1 shown in an unlocked position.
Figure 5:
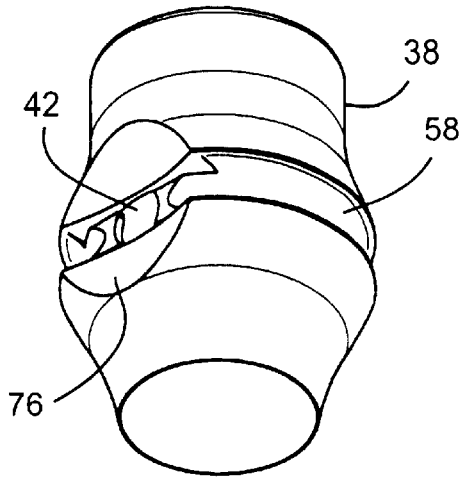
FIG. 5 is a perspective view of a connector sleeve of the locking mechanism of FIG. 1.
Figure 6:
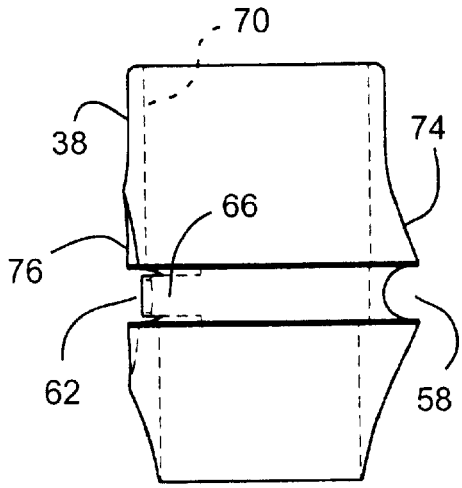
FIG. 6 is a side view of the connector sleeve of FIG. 1.
Figure 7:
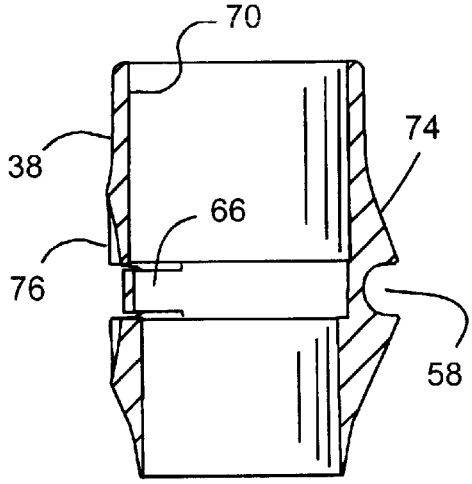
FIG. 7 is a cross-sectional side view of the connector sleeve of FIG. 1.
Figure 8:
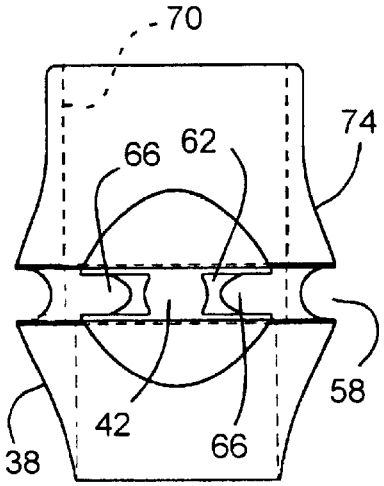
FIG. 8 is a front view of the connector sleeve of FIG. 1.
Figure 9:
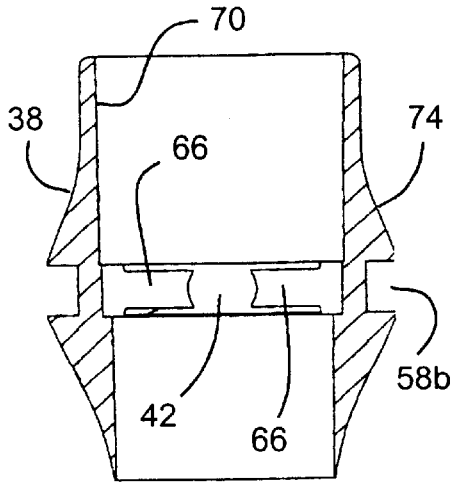
FIG. 9 is a cross-sectional back view of the connector sleeve of FIG. 1.
Figure 10:
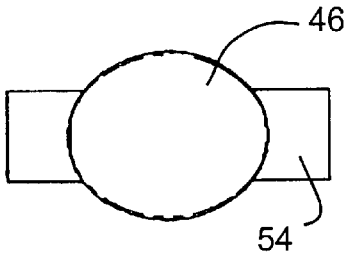
FIG. 10 is a front view of a button and a band of the locking mechanism of FIG. 1.
Figure 11:
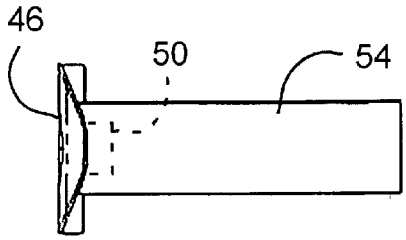
FIG. 11 is a side view of the button and the band of FIG. 1.
Figure 13:
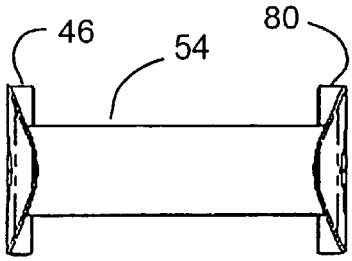
FIG. 13 is a side view of the button and the band of FIG. 12.
Figure 14:
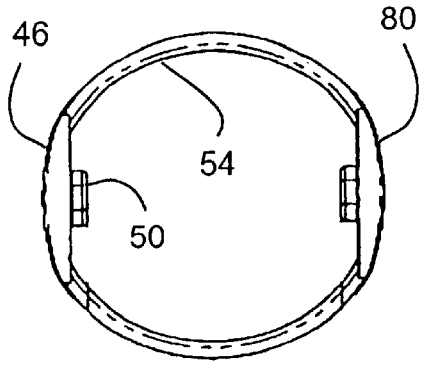
FIG. 14 is a top view of the button and the band of FIG. 12.
Figure 12:
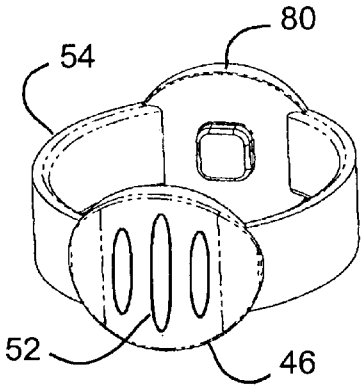
FIG. 12 is a perspective view of another button and band in accordance with the present invention.
Figure 15:
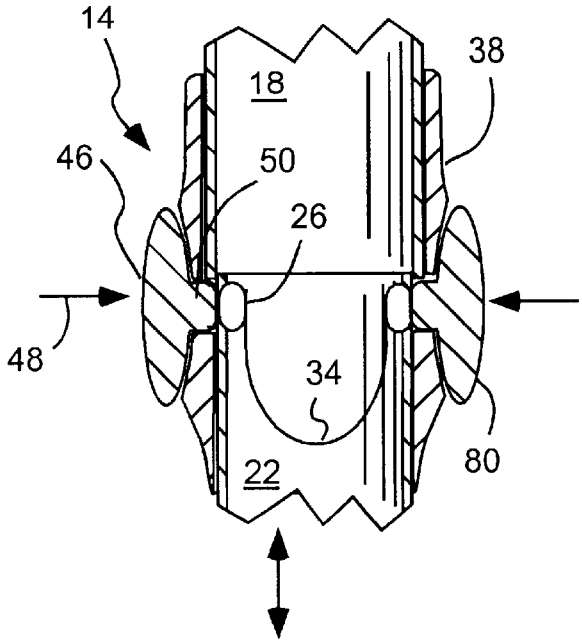
FIG. 15 is a cross sectional side view of another locking mechanism in accordance with the present invention with the button and band of FIG. 12.

The button(s) 46 are biased towards a locked configuration, or away from or outwardly from the sleeve 38 and detent(s) or pin(s) 26, as shown in FIG. 3. In one aspect, the button(s) 46 are disposed on an annular band 54 to secure the button(s) 46 to the sleeve 38, and to bias the button(s) 46 outwardly. The band 54 can be flexible or compliant, as well as resilient. Thus, the band 54 can be compressed from an original shape, such as circular, in the locked configuration, to a deformed shape, such as an ellipse, when the button(s) 46 are depressed in the unlocked configuration. The force exerted to depress the buttons also deforms the band 54. When the force is released, the band 54 resumes its original configuration, forcing the button(s) 46 outwardly.

The sleeve 38 can include a groove 58 that circumscribes a portion thereof. At least a portion of the band 54 can be disposed in the groove 58 to maintain the band 54 and button(s) 46 on the sleeve 38. Similarly, indentations 62 can be formed about the hole(s) 42 in the sleeve 38 to receive the button(s) 46. The band 54 can have a circular or curved cross-sectional shape. Thus, the groove 58 can have a circular cross-sectional shape to match the band. In another aspect, the band 54 can have a rectangular cross-sectional shape. Thus, the groove **58*b*** can have a rectangular cross-sectional shape to match the band.

Lateral wings or arms 66 can be formed on lateral sides of the hole(s) 42 in the sleeve 38. The wings 66 can have a fixed end secured to or formed into the sleeve 38, and a free end adjacent the hole 42. The wings 66 can be flexible and resilient to bend inwardly as the button 46 is depressed. The wings 66 can act as spring elements to further bias the button(s) 46 outwardly. The band 54 or button(s) 46 can contact the wings 66 as the button(s) 46 are depressed inwardly, deforming the wings 66 inwardly. When the force is released, the wings 66 can also exert a force outwardly to bias the button(s) 46 outwardly.

In use, the pole 10, or sections 18 and 22, can be either extended or retracted by sliding the inner section 22 into or out of the outer section 18. If the sections 18 and 22 are secured together, they can be released by releasing the locking mechanism, such as by depressing the button(s) 46. In one aspect, two buttons 46 are located on opposite sides of the sleeve 38. Thus, the locking mechanism 14 can be released by squeezing the locking mechanism 14 or buttons 46. Depressing the button(s) 46 causes the button(s) or protrusions 50 thereon to push against the detent(s) or pin(s) 26, displacing the detent(s) or pin(s) out of the hole(s) 42 in the sleeve 38. The inner section 22 can then be selectively positioned with respect to the outer section 18.

In addition, depressing the button(s) 46 causes the band 54 to deform, and the wings 66 to bend or deform inwardly. The deformed band 54 and deformed wings 66 store energy. When the button(s) 46 are released, the force stored by the band 54 and/or wings 66 forces the button(s) 46 outwardly, thus allowing the pin(s) 26 to again be received in the hole(s) 42 of the sleeve 38.

To collapse or retract the pole 10, the inner section 22 is slid into the outer section 18. The inner section 22 can include two detent or pin mechanisms located at opposite ends of the section, and corresponding to extended and retracted configurations. For example, an upper pin mechanism 68 located at the top of the inner section 22 can engage the hole 42 in the sleeve 38 when the inner section 22 is extended from the outer section 18, corresponding to an extended configuration and longer length. A lower pin mechanism 69 located at the bottom of the inner section 18 can engage the hole 42 in the sleeve 38 when the inner section 22 is inserted into the outer section 18, corresponding to a retracted configuration and shorter length.

It is of course understood that the pole 10 can be configured to adjust between multiple lengths, and thus have multiple discrete lengths. Thus, multiple detents or pin mechanisms can be disposed in the sections.

The sleeve 38 has an inner bore extending therethrough to slidably receive the inner section 22. An outer bore 70 can be formed in the upper side of the sleeve 38 to receive the lower end of the outer section 18 therein. The sleeve 38 can be attached to the outer section 18, such as by press fit, adhesives, etc.

The sleeve 38 can have an enlarged portion 74 in which the groove 58 is formed, and in which the indentations 62 are formed. In addition, an indentation 76 can be formed in the sleeve 38, or enlarged portion 74 thereof, to receive the button 46 when depressed.

Referring to FIGS. 12–15, the locking mechanism can be provided with two buttons 46 and 80 formed on opposite sides of the band 54. The buttons 46 and 80 can correspond to a pair of detent elements or pins disposed on opposite sides of the spring, and engaging opposite sides of the outer and inner sections. Thus, the user can squeeze the buttons 46 and 80 and band 54 to release the detent elements.

As stated above, the locking mechanism 14 can be used for both 1) one or two locking positions corresponding to extended and/or retracted position; and 2) multiple locking positions corresponding to multiple discrete positions and lengths. In one aspect, the locking mechanism 14 is utilized on the pole 10 in conjunction with an infinitely adjustable type mechanism. The locking mechanism 14 can interconnect two sections, such as the intermediate and lowermost sections, between extended and retracted configurations; while the infinitely adjustable type mechanism interconnects another two section, such as the uppermost and intermediate sections, at any position between extended and retracted configurations. Thus, both mechanisms can be used to extend and collapse the pole as desired, while the infinitely adjustable locking mechanism can further be utilized to selectively adjust the length of the pole to a desired length.

In addition, it will be appreciated that the detent elements or pins described above can have various different configurations. The detent elements or pins can extend through holes in the inner tube section and the outer tube section (and/or connector sleeve). In addition, the detent elements or pins can be associated with either the inner or outer tube sections.

It is to be understood that the above-referenced arrangements are illustrative of the application for the principles of the present invention. Numerous modifications and alternative arrangements can be devised without departing from the spirit and scope of the present invention while the present invention has been shown in the drawings and described above in connection with the exemplary embodiments(s) of the invention. It will be apparent to those of ordinary skill in the art that numerous modifications can be made without departing from the principles and concepts of the invention as set forth in the claims.

What is claimed is:

1. A lock device for a telescoping pole having an inner pole section movable with respect to an outer pole section, the device comprising:

a) a connector sleeve, configured to be disposed on the outer pole section, and configured to movably receive the inner pole section therein;

b) a detent element configured to releasably secure the inner pole section and the outer pole section with respect to one another when the detent element operatively engages to prevent the inner pole section from retracting into the outer pole section;

c) an annular band, extending around the connector sleeve; and d) a button, disposed on the annular band and carried by the connector sleeve and movably disposed over the detent element, and movable to an unlock position in which the button presses the detent element to disengage the detent element so that the inner pole section and outer pole section can move with respect to one another.

2. A device in accordance with claim 1, further comprising:

at least two pole sections including the inner pole section movable within the outer pole section.

3. A device in accordance with claim 1, further comprising:

a groove, formed in the connector sleeve, and receiving at least a portion of the annular band therein.

4. A device in accordance with claim 1, further comprising:

a) the annular band being flexible to allow the button to press the detent element; and b) the annular band being resilient to bias the button away from the detent element.

5. A device in accordance with claim 1, further comprising:

a flexible arm, disposed on the connector sleeve, to bias the button away from the detent element.

6. A device in accordance with claim 1, farther comprising:

a projection, disposed on the button, configured to press the detent element.

7. A device in accordance with claim 1, further comprising:

a) a pair of opposite detent elements configured to releasably secure the inner pole section and the outer pole section with respect to one another when the detent elements operatively engage; and b) a pair of buttons, disposed on opposite sides of a band, to press the detent elements to disengage the detent elements so that the inner pole section and outer pole section can move with respect to one another.

8. A device in accordance with claim 1, further comprising:

an indentation, formed in the connector sleeve, to receive the button therein in the unlock position.

9. An adjustable length ski or trek pole device, comprising:

a) at least two pole sections movably coupled together;

b) a connector sleeve, disposed on one of the pole sections, and movably receiving the other pole section therein, having an aperture formed therein;

c) a detent element, associated with the other pole section, engagable with the aperture of the connector sleeve to secure the pole sections with respect to one another;

d) an annular band, extending around the connector sleeve; and e) a button, disposed on the annular band and movably disposed on the connector sleeve over the aperture, and movable to an unlock position in which the button presses the detent element from the aperture in the connector sleeve so that the pole sections can move with respect to one another.

10. A device in accordance with claim 9, further comprising:

a groove, formed in the connector sleeve, and receiving at least a portion of the annular band therein.

11. A device in accordance with claim 9, further comprising:

a) the annular band being flexible to allow the button to press the detent element; and b) the annular band being resilient to bias the button away from the detent element.

12. A device in accordance with claim 9, further comprising:

a flexible arm, disposed adjacent the aperture of the connector sleeve, to bias the button away from the aperture and the detent element.

13. A device in accordance with claim 9, further comprising:

a projection, disposed on the button and facing the aperture of the connector sleeve, to press the detent element out of the aperture.

14. An adjustable length ski or trek pole device, comprising:

a) a plurality of telescoping pole sections telescopically coupled together, and movable with respect to one another between 1) an extended length in which the pole device has a longer length, and 2) a retracted length in which the pole device has a shorter length, the plurality of telescoping pole sections including at least an inner pole section movably received within an outer pole section;

b) a connector sleeve, disposed on one end of the outer pole section, and movably receiving the inner pole section therein, having an aperture formed therein;

c) a detent element engagable with the aperture of the connector sleeve to secure the inner pole section and the outer pole section with respect to one another;

d) an annular band, extending around the connector sleeve; and e) a button, disposed on the annular band and over the aperture in the connector sleeve, and movable to an unlock position in which the button presses the detent element from the aperture in the connector sleeve so that the inner pole section and outer pole section can move with respect to one another.

15. A device in accordance with claim 14, wherein the annular band is compliant to flex when the button is pressed to the unlock position, and is resilient to bias the button away from the detent element.

16. A device in accordance with claim 14, wherein the connector sleeve includes a groove, and wherein the annular band is disposed in the groove.

17. A device in accordance with claim 14, further comprising:

a flexible arm, disposed adjacent the aperture of the connector sleeve, to bias the button away from the aperture and the detent element.

18. A device in accordance with claim 14, wherein the plurality of pole sections includes;

a) an outermost and uppermost pole section with a handle disposed on an upper end thereof;

b) an intermediate pole section, slidably disposed in the outermost and uppermost pole section; and c) en innermost and lowermost pole section, slidably disposed in the intermediate pole section, with a tip disposed on a lower end thereof; and wherein the connector sleeve includes:

a) an upper connector sleeve, disposed on one end of the outermost and uppermost pole section, and movably receiving the intermediate pole section therein; and b) a lower connector sleeve, disposed on one end of the intermediate pole section, and movably receiving the innermost and lowermost pole section therein.

19. A lock device for a telescoping pole having an inner pole section movable with respect to an outer pole section, the device comprising;

a) a connector sleeve, configured to be disposed on the outer pole section, and configured to movably receive the inner pole section therein, having an aperture formed therein;

b) an annular band, extending around the connector sleeve;

c) a detent element configured to releasably secure the inner pole section and the outer pole section with respect to one another when the detent element operatively engages to prevent the inner pole section from retracting into the outer pole section;

d) a button, disposed on the annular band and moveably disposed over the detent element, and movable to an unlock position in which the button presses the detent element to disengage the detent element so that the inner pole section and outer pole section can move with respect to one another; and e) a flexible eon, disposed adjacent the aperture of the connector sleeve, to bias the button away from the aperture and the detent element.

* * * * *